United States Patent [19]

Delany

[11] Patent Number: 4,898,321

[45] Date of Patent: Feb. 6, 1990

[54] CASE AND PALLET SYSTEMS

[76] Inventor: Paul N. Delany, 120 Maldon Road, Danbury, Essex, England

[21] Appl. No.: 185,117

[22] Filed: Apr. 27, 1988

[30] Foreign Application Priority Data

Apr. 22, 1987 [GB] United Kingdom ..... 8709464

[51] Int. Cl.[4] ..... B65D 90/12; B65D 19/04

[52] U.S. Cl. ..... 229/23 R; 108/51.3; 108/55.1; 206/598; 206/599

[58] Field of Search ..... 108/51.3, 55.1; 206/596, 598, 599, 600; 229/23 R, 125.28, 125.29, 125.32

[56] References Cited

U.S. PATENT DOCUMENTS

| | | | |
|---|---|---|---|
| 3,216,376 | 11/1965 | Anderson et al. | 108/51.3 |
| 3,302,593 | 2/1967 | Roberts | 108/51.3 |
| 3,442,434 | 5/1969 | Simas | 229/23 R |
| 3,480,196 | 11/1969 | Simas | 108/51.3 |
| 3,568,912 | 3/1971 | deSimas | 229/23 R |
| 3,911,834 | 10/1975 | Quaintance | 108/51.3 |

FOREIGN PATENT DOCUMENTS

| | | | |
|---|---|---|---|
| 1181764 | 6/1959 | France | 108/51.3 |
| 2495109 | 6/1982 | France | 206/599 |
| 216452 | 10/1967 | Sweden | 108/51.3 |
| 1503507 | 3/1978 | United Kingdom | 206/600 |
| 2173173A | 10/1986 | United Kingdom . | |

*Primary Examiner*—Gary Elkins

*Attorney, Agent, or Firm*—Marjama & Pincelli

[57] ABSTRACT

A pallet base for a corrugated board case comprises a tray having a flat central zone and a foldable margin which, when folded from a flat state to an erect state, defines peripheral feet which incorporate flaps which can be folded inwards to overlie the central zone and thereby maintain peripheral tray flaps of the pallet base in an erect position. The inwardly foldable flaps may be held turned in through at least 90° by elastic bands which are readily removable to return the base to a fully flat condition.

9 Claims, 4 Drawing Sheets

CASE AND PALLET SYSTEMS

FIELD OF THE INVENTION

This invention relates to case and pallet systems, and is particularly concerned with a combination case and pallet unit for use as a container for the shipment or transportation of goods.

DESCRIPTION OF THE PRIOR ART

It is known, particularly when dealing with very heavy goods, to support a case or container on a rigid wooden pallet. Such an arrangement has a number of disadvantages. The wooden pallets are heavy and, if not re-used, are not easy to dispose of. Additionally, it is relatively expensive to produce wooden pallets of this type, both in terms of the basic cost of the materials and also in terms of their manufacture.

My pending UK patent application GB-2173173A describes a combination case and pallet unit which comprises a case with recesses and feet at one end of the case to receive pick-up forks or arms. A tray which is a pallet base for the case is removably insertable into this one end of the case to provide support for the case without obstructing the recesses. The case and tray can each be folded flat. The tray can be erected, by folding, from a flat state to an assembly state in which the margins of the tray are upstanding. The tray and the bottom edge of the case at said one end are preferably clipped together so that the bottom edge of the case is clear of the ground in use. The folded margins of the tray are preferably reinforced by rigid wooden, metal or plastics support members shaped to correspond with the recesses in the bottom of the case.

While the combination case and pallet unit described in my aforesaid patent application functions well, the present invention is concerned with improving the product as described therein.

SUMMARY OF THE INVENTION

It is an object of the present invention to provide an improved pallet base which gives greater support in the zone between the outer feet and the central support. Thus, heavy goods placed in the case between the peripheral feet and the central support will no longer cause distortion of the tray.

It is a further object of the present invention to provide an improved pallet base which is designed so that it is very much easier and quicker to introduce the pallet base into the case during the assembly process.

It is yet a further object of the present invention to provide a pallet base, the design of which is such that an even stacking of goods within the case is facilitated and problems of weight distribution are minimised.

It is a further object of the present invention to provide a pallet base which can be made wholly from corrugated material, without any need for rigid reinforcements.

It is yet another object of the present invention to provide a combination case and pallet unit in which both the case and the pallet base are truly "fold flat" items, thus providing for ease of storage. Additionally, the combination case and pallet unit can be re-used or, if required, if made wholly of corrugated material, can be re-cycled.

In accordance with one aspect of the present invention there is provided a pallet base for a case, the pallet base comprising a flat central zone and a foldable margin which, when folded from a flat state to an erect state, defines peripheral feet which incorporate flaps which can be folded inwards to overlie the central zone, thereby to maintain peripheral tray flaps of the pallet base in an erect position.

The inwardly turned flaps are preferably held turned in through at least 90° by retaining means, for example elastic bands.

Also in accordance with the invention there is provided a pallet base comprising a rectangular tray having a flat central zone and a projecting portion the length of each side of the central zone, each said projecting portion being foldable between a flat position and an erected position turned through 90°from the flat position, and a support member associated with each said projecting portion, each support member being secured in face-to-face contact with its associated projecting portion and overlying a marginal part of the central zone when the projecting portion is in its flat position, and each support member defining flaps which when the projecting portion is in its erected position can be folded inwardly to overlie the marginal part of the central zone and thereby maintain the projecting portion erect.

The foldable margin of the pallet base is preferably formed in four parts, one for each side of the pallet, base, with each foldable part being die-cut to define the inwardly foldable flaps. In the combination case and pallet unit described in my aforesaid UK patent application the bottom margin of the case and the pallet were connected together by clips, primarily to protect the base of the unit against water. The unit of the present invention dispenses entirely with any such clips, using the peripheral feet which incorporate the inturned flaps to create a strong support margin around the base of the case.

The invention also includes a case and pallet unit comprising a case with recesses in the case walls at one end of the case adapted to receive pick-up forks or arms, and a pallet base which is removably insertable in said one end of the case to provide support for the case without obstructing the recesses, in which the pallet base is such that it can be erected, by folding, from a fully flat state into a state ready for assembly into the case in which the margins of the base are upstanding, in which the foldable margins of the base are reinforced by support members shaped to correspond with the recesses in the bottom of the case, and in which the foldable margins of the base, when upstanding, define foldable flaps which can be folded inwards to overlie the central zone of the base, thereby to maintain the folded base margins in an upstanding position.

The pallet base can be located within the case by providing appropriate simple detent means between the pallet base and the case. For example, simple tabs on each end of the pallet base can be provided to locate in corresponding cutouts in the case, thus maintaining the integrity of the pack and providing ease of assembly.

BRIEF DESCRIPTION OF THE DRAWINGS

In order that the invention may be fully understood, one presently preferred embodiment will now be described by way of example and with reference to the accompanying drawings. In the drawings.

DESCRIPTION OF THE PREFERRED EMBODIMENT

Figure 1:
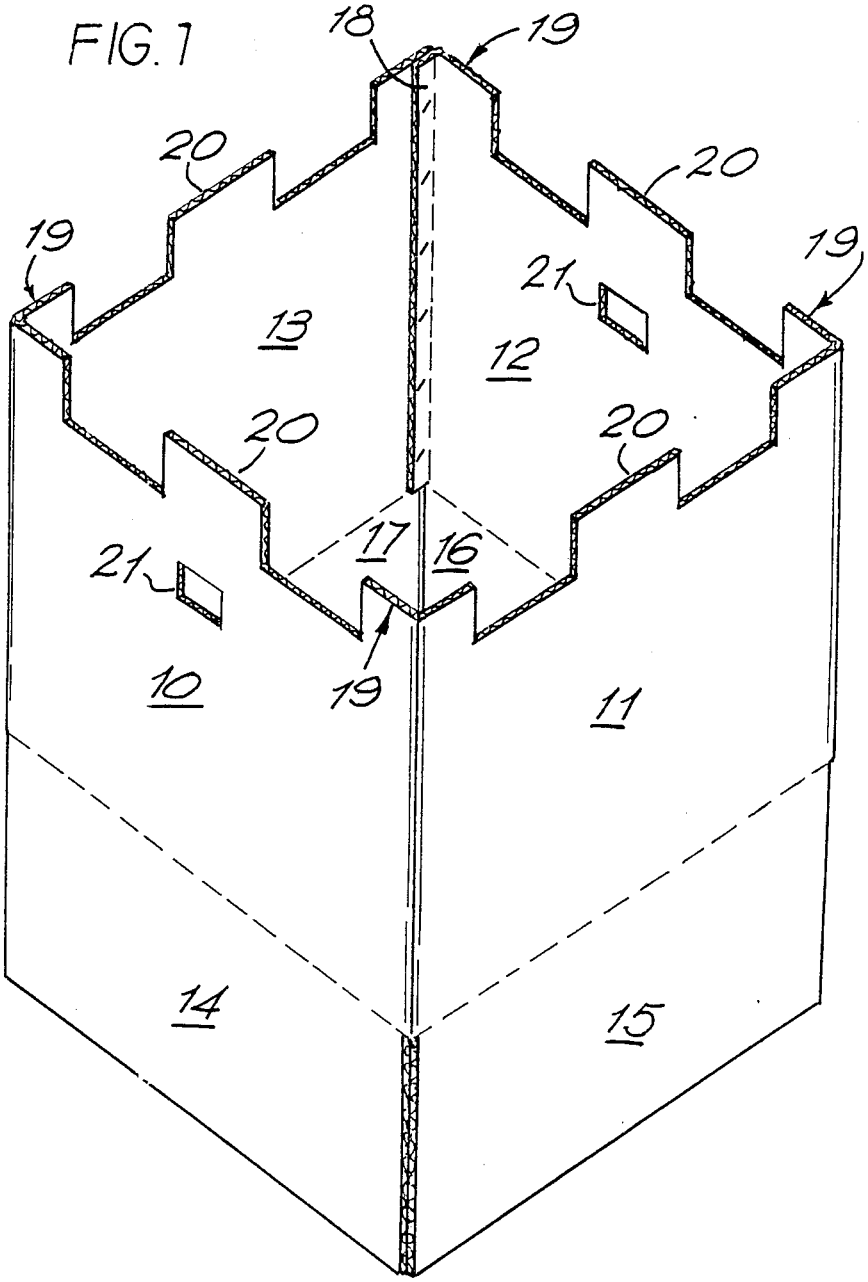
FIG. 1 is a view of a case opened up ready to receive a pallet base.

Referring first to FIG. 1, this shows the case of the combination case and pallet unit. The case can be manufactured from corrugated board or fiberboard in a conventional manner. The case comprises a blank which is cut and scored to define four sides 10,11,12 and 13, and four top flaps 14,15,16 and 17, with an open bottom which, with the case as shown in FIG. 1, is directed upwards in a ready-for-assembly position. A stitching flap 18 is provided along one edge of side 12 of the case. The case is therefore what is known as an open-top-style case.

The bottom margin of the case is shaped to define a plurality of projecting feet with intermediate recesses. These feet and recesses can be made by using suitable cut-out tools on the drum of a rotary slotting machine, or alternatively the case can be die-cut as a whole or with additional scores and slots to mark out the recesses to facilitate the utilisation of standard manufacturing techniques. As shown in FIG. 1, the case here has four corner feet 19 and intermediate feet 20 positioned centrally along the bottom margin of each side of the case. These feet 19,20 which are formed out of the material of the case itself thus define recesses between the feet which are dimensioned to correspond to the required entry dimensions for the forks of a forklift truck or for the arms of a pallet truck. The provision of recesses in each of the sides of the case is necessary in order to provide for fourway entry of such forks or arms. However, with a case which is rectangular in shape with one dimension substantially longer than the other, the recesses in two of the opposed sides of the case may be too small and/or too close together for the forks of a truck, and the case will then be suitable for two-way entry only. Such a unit is still within the scope of the present invention.

The sides 10 and 12 of the case as shown in FIG. 1 are provided with rectangular holes 21 for a purpose which will become apparent hereinafter. These holes 21 are positioned in alignment with the intermediate feet 20 on those two sides of the case.

Figure 2:
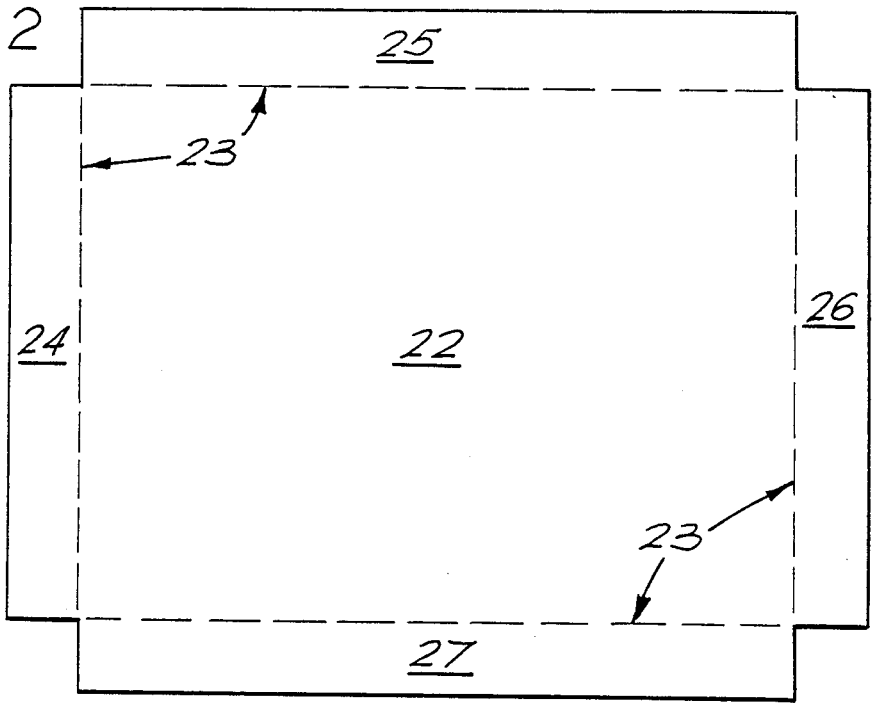
FIG. 2 is a plan view, from above, of a pallet base in accordance with the invention in its flat state before erection.
Figure 3:
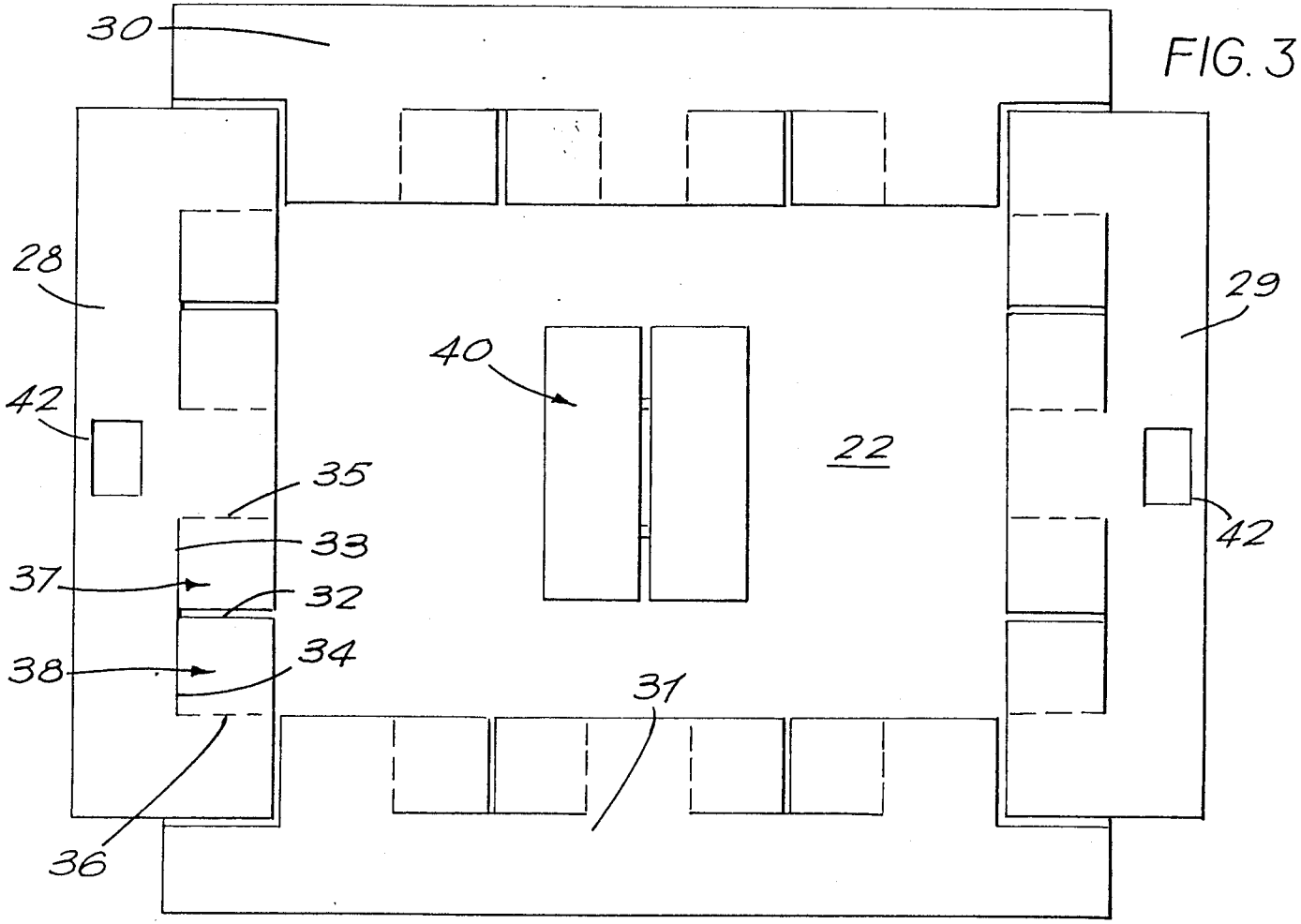
FIG. 3 is a plan view, from below, of the flat pallet base shown in FIG. 2.
Figure 5:
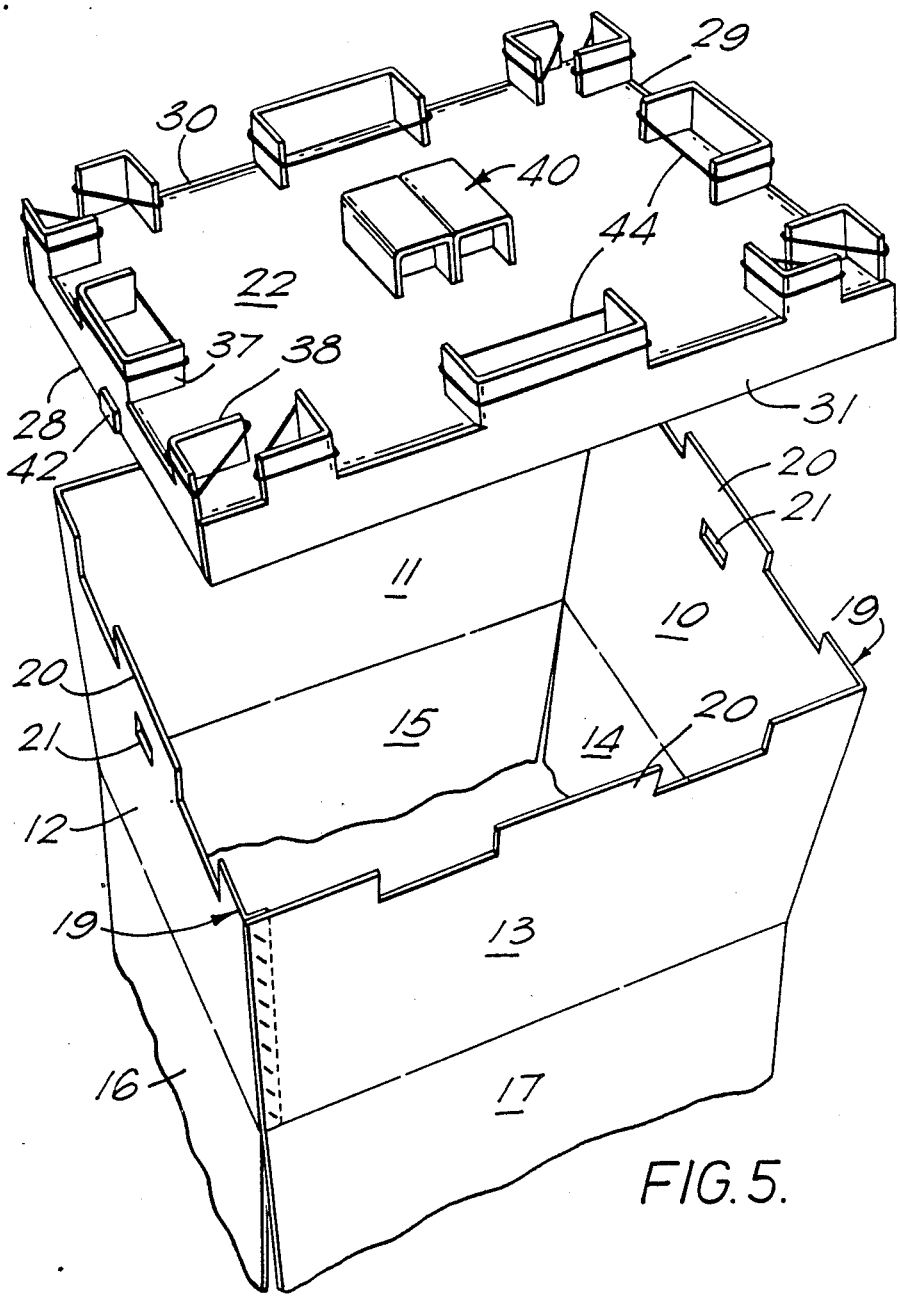

Referring now to FIGS. 2 and 3, these show the pallet base which is to be fitted into the open, upwardly facing, bottom end of the case shown in FIG. 1. The pallet base comprises a tray portion 22 which is square or rectangular in shape and has four marginal flaps 24,25,26 and 27. Fold lines 23, shown as broken lines in FIG. 2, are provided between each of the marginal flaps 24,25,26,27 and the central zone of the tray blank. The tray blank 22 may be made of any suitable material, preferably a heavy duty corrugated board material, for example triple-wall board. As is shown clearly in FIG. 3, the underside of the tray blank is provided with four support members 28,29,30 and 31. These support members 28 to 31 overlie the respective marginal flaps 24 to 27 of the tray blank and are secured to the tray blank 22 only over the area which is common with the marginal flaps 24 to 27. Such securement is achieved most simply by gluing the support members to the marginal flaps. Two of the support members 30 and 31 are suitably recessed at their inward corners to accommodate the other pair of support members 28 and 29.

Each of the support members 28 to 31 is die-cut in two places, as indicated at 32, and then again at right-angles to each such cut, as indicated at 33 and 34. Fold lines 35 and 36 are provided parallel to the first cut 32, thereby to form a pair of flaps 37 and 38. Each of the support members 28 to 31 is provided with two pairs of such flaps 37 and 38 which are dimensioned and spaced to correspond with the recesses between the feet 19 and 20 in the bottom of the case. It will also be appreciated from FIG. 3 that the depth of the cut or slot 32 is such that the bottom of the cut or slot is at the fold line 23 which marks the boundary between the marginal flap and the central zone of the tray blank.

As can also be seen from FIG. 3, the center of the underside of the pallet base is provided with a central support indicated generally at 40 and which can be made by folding up a portion of blank material, suitably cut and glued to the underside of the tray blank.

Two opposed support members 28 and 29 are each provided with a tab 42 which is dimensioned and positioned to latch into the corresponding holes or slots 21 in the sides 10 and 12 of the case.

Figure 4:
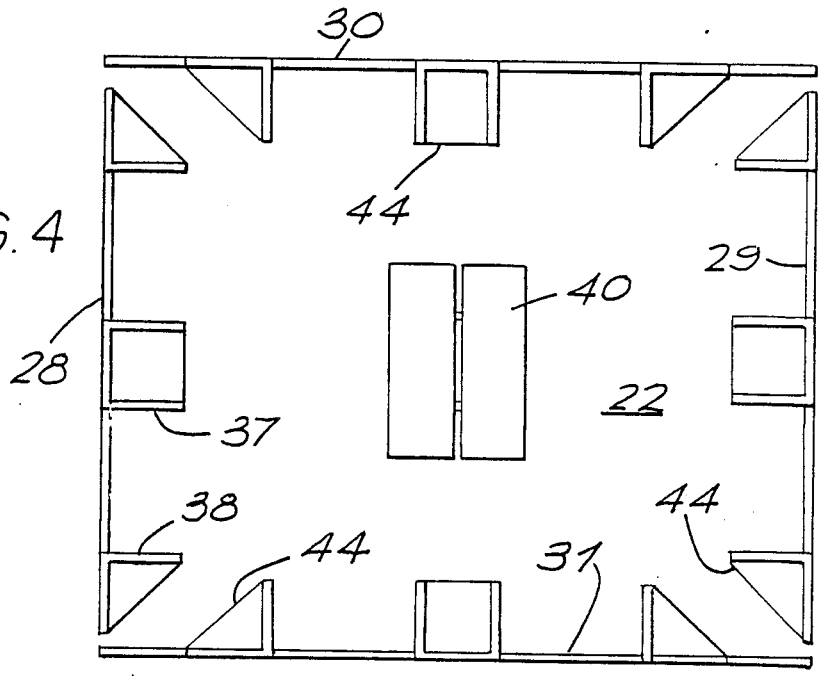
FIG. 4 is a plan view, from below, of the pallet base of FIG. 3 with the sides erected and the flaps deployed and, FIG. 5 is an exploded perspective view of a case and pallet assembly made in accordance with the present invention.

It will be appreciated that in its initial form the pallet base is completely flat, with the support members lying as shown in FIG. 3 and with the central support 40 folded out flat. In order to erect the pallet base for assembly into the case it is only necessary to turn the four support members 28 to 31 about the fold lines 23 of the tray blank and then to fold the individual flaps 37 and 38 inwards through 90°, as shown in FIG. 4. This simple action has two results. Firstly, the inturned flaps 37 and 38 then overlie the underside of the central zone of the tray blank and provide support for it at a plurality of spaced positions around the periphery of the base. Secondly, the very action of turning the support members and folding in the flaps 37 and 38 in itself erects the flaps 24 to 27 of the tray blank and also maintains them in their erect position. This greatly simplifies the handling of the pallet base and the ability to introduce it quickly and easily into the case.

In order to hold the inturned flaps 37 and 38 in a position in which they will not provide any barrier to the entry of the forks of a forklift truck in the assembled state of the base and case, suitable retaining means are provided for each flap or pair of flaps. As shown in FIG. 4, such retaining means can most easily and effectively be rubber bands 44. The advantage of rubber bands is that due to their inherent elasticity they tend to hold the inturned flaps 37 and 38 which define the feet of the pallet base in positions where the flaps are inturned through slightly more than 90°, thus making the entry ways for the forks slightly tapering and minimising any possibility of the forks striking the flaps of the opposing side of the unit when they are inserted. The tabs 42 latch into the holes 21 in the case when the pallet base is pushed into the bottom of the case. This serves to maintain the integrity of the combination unit and assists in the assembly of the two parts. It also prevents any subsequent movement of the case relative to the base, but yet provides a simple way in which the two parts can later be separated, i.e. simply by depressing the tabs 42 and pulling the base and case apart. It is then only necessary to remove the rubber bands 44 from the bottom feet and turn the flaps 37 and 38 back in order to revert to a fully flat pallet base. The combination unit is therefore particularly well adapted for re-use and for ease of storage between times.

The case and pallet base may be made of any suitable material or materials. In particular, the four support members 28,29,30 and 31 are preferably made of a heavy duty corrugated board material, for example triple-wall board.

I claim:

1. A pallet base for a case, the pallet base comprising a flat rectangular central portion and a peripheral flange portion at at least two opposed edges of the central portion, each flange portion being foldable from a flat state to an erect state in which the flange portion defines both an upstanding portion above the level of the central portion and a depending skirt portion below the level of the central portion, the skirt portion of each flange portion having flaps which can be folded inwards to overlie the underside of the central portion thereby to maintain the flange portions in an erect position, and retaining means comprising elastic bands to hold each of said flaps turned inwards through at least 90°.

2. A pallet base according to claim 1, in which each peripheral flange portion comprises a foldable extension of the rectangular central portion and a support member secured in face-to-face overlying relationship on the foldable extension, the support member providing the said flaps.

3. A pallet base for a case, the pallet base comprising a rectangular tray having a flat central portion and a projecting portion along the length of each side of the central portion, each said projecting portion being foldable between a flat position and an erected position turned through 90° from the flat position, and a support member associated with each said projecting portion, each support member being secured in face-to-face contact with its associated projecting portion and overlying a marginal parts of the central portion when the projecting portion is in its flat position, and each support member defining flaps which when the projecting portion is in its erected position can be folded inwardly to overlie the marginal part of the central portion and thereby maintain the projecting portion erect.

4. A pallet base according to claim 3, including retaining means to hold said flaps turned in through at least 90°.

5. A pallet base according to claim 3, in which each support member defines two pairs of foldable flaps.

6. A pallet base according to claim 3, in which the support members are made of a heavy duty corrugated board material.

7. A case and pallet unit comprising a case having case walls with recesses in the case walls at one end of the case adapted to receive pick-up forks or arms, and a pallet base which is removably insertable in said one end of the case to provide support for the case without obstructing the recesses, in which the pallet base is such that it can be erected, by folding, from a fully flat state into a state ready for assembly into the case in which marginal portions of the base are upstanding, in which the marginal portions of the base comprise reinforcing support members shaped to correspond with the recesses in the bottom of the case, and in which the support members, when upstanding, define foldable flaps which can be folded inwards to overlie a central portion of the base, thereby to maintain the marginal portions of the base in an upstanding position.

8. A case and pallet unit according to claim 7, made entirely of corrugated board material.

9. A case and pallet unit according to claim 7, which includes elastic retaining means to hold the flaps turned inwards through at least 90°.

* * * * *